US006441545B1

(12) United States Patent
Shimizu et al.

(10) Patent No.: US 6,441,545 B1
(45) Date of Patent: Aug. 27, 2002

(54) COLOR CATHODE RAY TUBE HAVING PARTICULAR ARRANGEMENT OF ELECTRON BEAM THROUGH HOLE ARRAYS

(75) Inventors: Norio Shimizu; Shinichiro Nakagawa; Takuya Mashimo, all of Fukaya; Masatsugu Inoue, Kumagaya, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/260,014

(22) Filed: Mar. 2, 1999

(30) Foreign Application Priority Data

Mar. 3, 1998 (JP) ..... 10-050691

(51) Int. Cl.[7] ..... H01J 29/07; H01J 29/06

(52) U.S. Cl. ..... 313/402; 313/403; 313/408; 313/407

(58) Field of Search ..... 313/402, 403, 313/404, 407, 408

(56) References Cited

U.S. PATENT DOCUMENTS 4,701,665 A * 10/1987 Suzuki ..... 313/402
5,672,934 A 9/1997 Ohama et al.
6,204,599 B1 * 3/2001 Yamazaki ..... 313/402

FOREIGN PATENT DOCUMENTS

JP 59165341 * 9/1984 ..... H01J/29/30

* cited by examiner

*Primary Examiner*—Nimeshkumar D. Patel
*Assistant Examiner*—Karabi Guharay
(74) *Attorney, Agent, or Firm*—Oblon, Spivak, McClelland, Maier & Neustadt, P.C.

(57) ABSTRACT

In a color cathode ray tube in which the external surface of an effective portion of a panel has a flat surface or a slight curvature, the shadow mask is set such that the layout distance between electron beam through hole array near the long side of an effective surface of the shadow mask is larger in the vicinity of the short axis than the layout distance at the center of the effective surface. Further, the layout distance becomes gradually smaller in direction away from the short axis, and thereafter, the layout distance changes to an increase. In the vicinity of the short side of the effective surface, the layout distance becomes equal to or larger than the layout distance near the short axis. Therefore, the curvature of the shadow mask and the electron beam through hole array are set in proper condition, and mislanding of beam landing due to deformation or oscillation of the shadow mask can be reduced. At the same time, howling of the phosphor screen can be minimized.

6 Claims, 10 Drawing Sheets

| | | INCLINATION ANGLE (DEGREE) | | | | | | | | | | | |
|---|---|---|---|---|---|---|---|---|---|---|---|---|---|
| Y-COORDINATE (mm) | 0.0 | 0.000 | 0.000 | 0.000 | 0.000 | 0.000 | 0.000 | 0.000 | 0.000 | 0.000 | 0.000 | 0.000 | 0.000 |
| | 30.0 | 0.000 | 0.283 | 0.496 | 0.584 | 0.530 | 0.352 | 0.111 | -0.120 | -0.263 | -0.284 | -0.258 | -0.295 |
| | 60.0 | 0.000 | 0.446 | 0.790 | 0.952 | 0.901 | 0.655 | 0.288 | -0.104 | -0.411 | -0.549 | -0.538 | -0.533 |
| | 90.0 | 0.000 | 0.422 | 0.769 | 0.973 | 1.001 | 0.838 | 0.512 | 0.070 | -0.397 | -0.752 | -0.800 | -0.653 |
| | 120.0 | 0.000 | 0.248 | 0.478 | 0.659 | 0.760 | 0.728 | 0.529 | 0.149 | -0.379 | -0.871 | -0.930 | -0.615 |
| | 150.0 | 0.000 | 0.114 | 0.190 | 0.199 | 0.116 | -0.059 | -0.310 | -0.603 | -0.865 | -0.970 | -0.714 | -0.378 |
| | 177.4 | 0.000 | 0.355 | 0.414 | 0.012 | -0.857 | -1.932 | -2.838 | -3.195 | -2.681 | -1.326 | -0.048 | -0.078 |
| | | 0.0 | 30.0 | 60.0 | 90.0 | 120.0 | 150.0 | 190.0 | 210.0 | 240.0 | 270.0 | 300.0 | 314.0 |
| | | X-COORDINATE (mm) | | | | | | | | | | | |

FIG. 9

| | | RADIUS OF CURVATURE (mm) | | | | | | | |
|---|---|---|---|---|---|---|---|---|---|
| Y-COORDINATE (mm) | 0.0 | 1263.1 | 1422.3 | 1594.4 | 1792.9 | 1678.5 | 1173.9 | 2520.2 | 1628.6 |
| | 50.0 | 1155.5 | 1166.2 | 1200.1 | 1257.9 | 1318.4 | 1300.0 | 1285.1 | 1322.6 |
| | 100.0 | 857.8 | 848.4 | 826.3 | 815.5 | 886.8 | 1294.6 | 745.9 | 1016.6 |
| | 150.0 | 738.1 | 798.8 | 945.6 | 965.9 | 790.9 | 630.3 | 2522.0 | 1384.3 |
| | 178.0 | 793.0 | 1039.7 | 2779.4 | 4729.5 | 821.8 | 362.4 | 566.4 | 27452.5 |
| | | 0.0 | 50.0 | 100.0 | 150.0 | 200.0 | 250.0 | 300.0 | 314.0 |
| | | X-COORDINATE (mm) | | | | | | | |

FIG. 12

COLOR CATHODE RAY TUBE HAVING PARTICULAR ARRANGEMENT OF ELECTRON BEAM THROUGH HOLE ARRAYS

BACKGROUND OF THE INVENTION

The present invention relates to a color cathode ray tube, and relates, more particularly, to a color cathode ray tube capable of reducing displacement of beam landing attributable to deformation of a shadow mask or oscillation and capable of reducing howling of a phosphor screen, by setting in suitable conditions the curvature of an effective surface of the shadow mask and electron beam through hole rows formed by a plurality of electron beam through holes.

In general, a color cathode ray tube has a vacuum envelop composed of an almost rectangular panel 3 provided with a skirt 2 at the periphery of an effective portion 1 having a curved surface, and a funnel 4 connected to the skirt 2, as shown in FIG. 1. A phosphor screen 5 is provided on the inner surface of the effective portion 1 of the panel 3. At the inside of the phosphor screen 5, there is disposed an almost rectangular shadow mask 9, composed of a mask main body 7 having a large number of electron beam through holes or apertures on an effective surface 6 formed in an almost rectangular curved surface opposite to the phosphor screen, and an almost rectangular mask frame 8 fitted to the periphery of the mask main body 7. In the mean time, within a neck 11 of the funnel 4, there is disposed an electron gun assembly 13 for discharging three electron beams 12B, 12G and 12R. The three electron beams 12B, 12G and 12R emitted from this electron gun assembly 13 are deflected by a magnetic field generated from a deflector 14 mounted on the outside of the funnel 4. These three electron beams 12B, 12G and 12R are then selected by the shadow mask 9 and are directed to the phosphor screen 5. When the phosphor screen 5 is scanned both horizontally and vertically by the three electron beams 12B, 12G and 12R, a color image is displayed on the phosphor screen 5.

In this color cathode ray tube, the holes or apertures formed on the effective surface 6 of the shadow mask 9, through which the electron beams pass, are arranged as follows. A plurality of electron beam through holes are laid out in one line along a short axis (Y axis) direction of the shadow mask, and a plurality of these electron beam through hole array or aperture array composed of the plurality of electron beam through holes in the short axis direction are arranged in a long axis (X axis) direction of the shadow mask. Corresponding to this arrangement of the electron beam through holes, the phosphor screen 5 is structured by black strip layers, i.e., non-light emitting layers extending in the short axis direction, and three-color phosphor layers buried between the black non-light emitting layers. The color cathode ray tube having this structure is called an in-line type, and has been in practical use.

Generally, in order to achieve a display of an image without any color purity degradation on the phosphor screen of a color cathode ray tube, it is essential that each of the three electron beams passing through the electron beam through holes of the shadow mask makes a correct landing on the three color phosphor layer of the phosphor screen. In order to perform a correct landing of the three electron beams, it is necessary that a distance (q value) between the inner surface of the effective portion of the panel and the effective surface of the shadow mask is set at a value within a predetermined permissible range.

In recent years, in order to improve the visibility of an image, color cathode ray tubes have been designed to have a flat surface or almost a flat surface, with a smaller curvature, for the external surface of the effective portion of the panel. These color cathode ray tubes need to have a smaller curvature for the internal surface of the effective portion of the panel, for obtaining good visibility of an image and from the viewpoint of forming the panel. In this case, the effective surface of the shadow mask needs to have a small curvature corresponding to the curvature of the internal surface of the effective portion of the panel, in order to obtain a suitable distance from the internal surface of the effective portion of the panel.

However, the reduction in the curvature of the effective surface of the shadow mask involves such risks that the strength of the curved surface becomes weak, that a local deformation occurs in the shadow mask and the color cathode ray tube at the manufacturing stage, and that color purity is deteriorated. Further, when the color cathode ray tube is built into the image receiver, a howling occurs by the sound from the speaker, which lowers the color purity.

On the other hand, if the curvature of the effective surface of the shadow mask is set large in an attempt to prevent deterioration of the color purity attributable deformation or oscillation of the shadow mask, and if the curvature of the internal surface of the effective portion of the panel is set to correspond to this curvature of the effective surface, then the curvature of the internal surface becomes larger for the shape of the external surface of the effective portion. This not only makes it difficult to form the panel, but also has a risk of a reduction in the visual field angle due to a total reflection and a deterioration in the visibility due to a reflected image on the internal surface of the panel.

There has already been made a proposal for preventing the deterioration of color purity attributable to deformation or oscillation of the shadow mask. According to this proposal, as shown in FIG. 2, the internal surface of an effective portion 1 of a panel 3 has a curvature in its short axis direction, and a radius of curvature in the long axis direction is set as infinite in its long axis direction from the center to an intermediate portion of the panel. The radius of curvature in the long axis direction near the periphery of the short side is formed in a larger curved surface than the radius of curvature in the long axis direction from the center to the intermediate portion. The effective surface of the shadow mask is formed in a similar curved surface corresponding to the internal surface shape of the effective portion 1 of the panel 3.

When the effective portion 1 of the panel 3 and the effective surface of the shadow mask are set in the curved shapes as explained above, it becomes possible to improve the strength of the curved surface of the shadow mask 9 and to increase the atmospheric pressure strength of the vacuum envelop at the same time. However, even in this, the curved surface strength of the shadow mask 9 is insufficient at portions near the center of the effective surface 6. Further, the phosphor screen formed on the internal surface of the effective portion 1 of the panel 3 is degraded.

In general, the phosphor screen of the color cathode ray tube is formed based on a photo-lithographic method, according to which the black non-light emitting layer is formed first and then the three-color phosphor layer is formed, for the phosphor screen that is composed of the non-light emitting layer and the three-color phosphor explained above.

According to this photo-lithographic method, at first, a photosensitive material is coated on the internal surface of an effective portion 1 of a panel 3, to form a photosensitive film 15, as shown in FIG. 3A. This photosensitive film 15 is exposed by utilizing a shadow mask 9. After the photosensitive mask 15 has been developed, a resist 17 in a striped pattern corresponding to an electron beam through hole 16 of the shadow mask shown in FIG. 3A, is formed as shown in FIG. 3B. Then, a black non-light emitting coating is coated on the internal surface of the effective portion 1 of the panel 3 on which the resist 17 has been formed. Thereafter, the coating is dried, and a black non-light emitting coated layer 18 is formed, as shown in FIG. 3C. After that, the black non-light emitting coated layer on the resist 17 is separated together with the resist 17, and a striped black non-light emitting layer 19 is formed, as shown in FIG. 3D.

Thereafter, a photosensitive phosphor slurry containing a phosphor and a photosensitive agent as main components is coated on the internal surface of the effective portion 1 of the panel 3 formed with the black non-light emitting layer 19, as shown in FIG. 3E. Then, this slurry is dried and a photosensitive phosphor slurry layer 21 is formed. This photosensitive phosphor slurry layer 21 is exposed similarly by utilizing the shadow mask 9 and is then developed. As a result, a striped blue phosphor layer 22B, for example, is formed in the striped space between the black non-light emitting layers 19, as shown in FIG. 3F. Thereafter, this method of forming a phosphor layer is repeated, and three-color phosphor layers 22B, 22G and 22R are formed in the striped space between the black non-light emitting layers 19, as shown in FIG. 3G.

For exposing the photosensitive film 15 and the photosensitive phosphor slurry layer 21, there are used the striped black non-light emitting layers 19 and a long light source which is long in the longitudinal direction of the phosphor layers 22B, 22G and 22R. This long light source having such a large length is used because a miss-landing of the electron beams in the longitudinal direction of the phosphor layers 22B, 22G and 22R does not affect the color purity in the in-line type color cathode ray tube. Therefore, it is not necessary to strictly approximate the light rays emitted from the light source to the locus of the electron beams emitted from the electron gun assembly. Moreover, the use of the long light source has such advantages that the exposure time can be reduced by an increased intensity of light beams emitted from the light source, and that it is possible to form the striped black non-light emitting layer 19 and the phosphor layers 22B, 22G and 22R, easily and continuously, without any break due to a bridge between the electron beam through holes.

However, if the above-described long light source is used, the panel 3 with the internal surface of the effective portion 1 having the curvature practically in only the short axis direction, with the curvature in the long axis direction almost infinite from the center to the intermediate portion in the long axis direction as shown in FIG. 2, has a problem that the longitudinal direction of a long light source 24 does not coincide with the longitudinal direction of a pattern 26 of one electron beam through hole 16 of the shadow mask 9 projected onto the internal surface of the effective portion 1 of the panel 3, as shown in FIG. 4A. Accordingly, as shown in FIG. 4B, there arises a displacement of Δ1 in the long axis direction at both ends 29*a* and 29*b* of the pattern 26 to which light beams 28*a* and 28*b* reach from both ends 27*a* and 27*b* of the long light source 24. This displacement Δ1 becomes a maximum at the intermediate portion of the long side of the effective portion 1.

Accordingly, as shown in FIGS. 5A and 5B, the black non-light emitting layers 19 and the phosphor layers 22B, 22G and 22R formed at the center of the effective portion 1 of the panel 3 form a normal stripe. However, the black non-light emitting layer 19 and the phosphor layers 22B, 22G and 22R make a zigzag shape at the intermediate portion in the long axis direction of the effective portion 1, which lowers the distinction or clearness of the phosphor screen near the intermediate portion of the long side and degrades the quality of the screen, as shown in FIG. 5C.

In order to prevent this degrading of the phosphor screen, there has been a conventional method according to which the internal surface of the effective portion of the panel is not exposed at the same time, but a shutter provided with apertures for partially exposing between the panel and the long light source is movably disposed, and in synchronism with the move of the shutter, the internal surface of the effective portion is exposed by slanting the long light source to make the longitudinal direction of the long light source coincide with the longitudinal direction of the pattern of the electron beam through holes of the shadow mask projected to the internal surface of the effective portion of the panel.

This exposure method, however, involves a complex structure of an exposing apparatus and requires a long exposure time as well.

Accordingly, there has recently been employed an exposure method according to which an optical lens is disposed on the long light source, and the locus of the light beam from the long light source is adjusted with this optical lens to carry out a simultaneous exposure of the internal surface of the effective portion of the panel.

However, this exposure method has a problem that in most cases it is not possible to sufficiently adjust the zigzag of the black non-light emitting layer and the phosphor layer.

In order to solve this zigzag of the black non-light emitting layer and the phosphor screen, there has been proposed a method in Jpn. Pat. Appln. KOKAI Publication No. 8-162034 (the corresponding U.S. application thereof matured into U.S. Pat. No. 5,672,934 (Ohama et al.) on Sep. 30, 1997). As shown in FIG. 6A and FIG. 6B, it is proposed that the electron beam through holes 16 of the shadow mask 9 has such a shape on the long side of the effective surface 6 that, in the area from the short side to a position apart from the short side at a distance of ¼ width of the effective surface, the width being defined as a distance between the short sides, the slope is the largest at the end of the long side of the electron through holes in a direction to approach the short axis from the end of the opposite long side, and in the area inside ⅓ of the short axis distance (long axis side) from the long side, the slope angle θ becomes larger in a direction away from the short axis and this slope angle is decreased or inverted to a minimum towards the short axis.

This shadow mask 9 is effective if the external surface of the panel has a curvature of about 2R. However, if the external surface of the panel is almost flat, there is a problem that the strength of the curved surface is reduced in the case where the distance between the internal surface of the effective portion of the panel and the effective surface 6 of the shadow mask 9 is set so as to have a suitable disposition of the stripe black non-light emitting layer and the phosphor layer.

As explained above, when the curvature of the external surface of the effective portion of the panel is decreased to have a flat surface or an almost a flat surface in an attempt to improve the visibility of an image, it is necessary to decrease the curvature of the internal surface of the effective portion of the panel. Along with this reduction, it is also necessary to decrease the curvature of the effective surface of the shadow mask. However, the reduction in the curvature of the effective surface of the shadow mask brings about the lowering of the strength of the curved surface, a local deformation of the shadow mask or the color cathode ray tube at a manufacturing stage, an oscillation due to a sound from the speaker when the color cathode ray tube has been built into the image receiver, resulting in the lowering of the color purity.

In order to prevent the lowering of the color purity attributable to deformation or oscillation of the shadow mask, there has been a proposal that the internal surface of the effective portion of the panel has a curvature in the short axis direction, and has almost a limitless radius of curvature in the long axis direction from the center to the intermediate portion in the long axis direction so that the radius of curvature in the long axis direction near the periphery of the short side is formed in a curved surface larger than the radius of curvature in the long axis direction from the center toward the intermediate portion, and that the effective surface of the shadow mask is formed to have a similar curved shape. However, even with this structure, the strength of the curved surface near the center of the effective surface of the shadow mask becomes insufficient. Further, this structure has a risk of causing a zigzag of the striped black non-light emitting layer and the three-color phosphor layer of the phosphor screen formed on the internal surface of the effective surface of the panel, and degrading the quality of the phosphor screen.

In order to prevent the zigzag of the black non-light emitting layer and the phosphor layer, there has also been proposed that, on the long side of the effective surface, in the area between a position with a distance of ¼ of the short side distance from the short side and the short side, the slope is the largest at the end of the long side of the electron beam through holes toward the short axis from the end of the opposite side, and in the inside area (long axis side) with a distance of ⅓ of the short side distance from the long side, this slope angle θ becomes larger in a direction away from the short axis, and the slope angle is decreased or is inverted to a minimum in a direction toward the short side. However, even with this structure, if the external surface of the panel is almost flat, there is a problem that the strength of the curved surface is reduced in the case where the distance between the internal surface of the effective portion of the panel and the effective surface of the shadow mask is set so as to have a suitable disposition of the stripe black non-light emitting layer and the phosphor layer.

BRIEF SUMMARY OF THE INVENTION

It is an object of the present invention to provide a color cathode ray tube capable of reducing displacement of beam landing attributable to deformation of a shadow mask or oscillation due to a sound from a speaker, and capable of reducing howling of a phosphor screen attributable to zigzag of a striped black non-light emitting layer and a phosphor layer, by setting in suitable conditions the curvature of an effective surface of the shadow mask and electron beam through hole rows formed by a plurality of electron beam through holes.

According to the present invention, there is provided a color cathode ray tube, comprising: an almost rectangular panel having a flat surface or having a slight curvature on its external surface; a phosphor screen formed on an internal surface of an effective portion of the panel; a mask main body, having an almost rectangular shadow mask disposed opposite to the phosphor screen, with a plurality of electron beam through holes being disposed in one line in a short axis direction of the shadow mask on an effective surface of an almost rectangular curved shape opposite to the phosphor screen, and with this electron beam through hole line formed by the plurality of electron beam through holes being laid out by a plurality of number in a long axis direction of the shadow mask; and an almost rectangular mask frame fitted to the periphery of the mask main body, wherein the shadow mask is structured such that the layout distance between the adjacent electron beam through holes near the long side of the effective surface is larger than the layout distance between the adjacent electron beam through holes at the center of the effective surface near the short axis of the shadow mask, and this layout distance becomes gradually smaller in a direction away from the short axis, and increases thereafter, and at a position near the short side of the effective surface, the layout distance becomes equal to or larger than the layout distance near the short axis.

In the color cathode ray tube, the effective surface of the shadow mask is structured such that the effective surface has a curvature in the short axis direction, and in an area between a position with a ⅓ distance of the short side distance in the long axis direction from the short axis and the short axis, the curvature in the short axis direction is a maximum near the short axis and the curvature becomes gradually smaller in a direction away from the short axis.

Further, according to the present invention, there is provided a color cathode ray tube, comprising: an almost rectangular panel; a phosphor screen formed on an internal surface of an effective portion of the panel; a mask main body, having an almost rectangular shadow mask disposed opposite to the phosphor screen, with a plurality of electron beam through holes being disposed in one line in a short axis direction of the shadow mask on an effective surface of an almost rectangular curved shape opposite to the phosphor screen, and with this electron beam through hole line formed by the plurality of electron beam through holes being laid out by a plurality of number in a long axis direction of the shadow mask; and an almost rectangular mask frame fitted to the periphery of the mask main body, wherein the shadow mask is structured such that the layout distance of the electron beam through hole array on the long axis increases gradually in a direction away from the short axis, and at a position near the long side of the effective surface, the layout distance becomes smaller at an intermediate portion in the long axis direction near the short axis.

Further, according to the present invention, there is provided a color cathode ray tube, comprising: an almost rectangular panel having a flat surface or having a slight curvature on its external surface; a phosphor screen formed on an internal surface of an effective portion of the panel; a mask main body, having an almost rectangular shadow mask disposed opposite to the phosphor screen, with a plurality of electron beam through holes being disposed in one line in a short axis direction of the shadow mask on an effective surface of an almost rectangular curved shape opposite to the phosphor screen, and with this electron beam through hole line formed by the plurality of electron beam through holes being laid out by a plurality of number in a long axis direction of the shadow mask; and an almost rectangular mask frame fitted to the periphery of the mask main body, wherein the shadow mask is structured such that the layout distance of the electron beam through hole array on the long axis increases gradually in a direction away from the short axis, and at a position near the long side of the effective surface, the layout distance becomes smaller at an intermediate portion in the long axis direction near the short axis.

Further, according to the present invention, there is provided a color cathode ray tube, comprising: an almost rectangular panel having a flat surface or having a slight curvature on its external surface; a phosphor screen formed on an internal surface of an effective portion of the panel; a mask main body, having an almost rectangular shadow mask disposed opposite to the phosphor screen, with a plurality of electron beam through holes being disposed in one line in a short axis direction of the shadow mask on an effective surface of an almost rectangular curved shape opposite to the phosphor screen, and with this electron beam through hole line formed by the plurality of electron beam through holes being laid out by a plurality of number in a long axis direction of the shadow mask; and an almost rectangular mask frame fitted to the periphery of the mask main body, wherein the shadow mask is structured such that, at a position near the short axis, the slope of the electron beam through hole array near the long side of the effective surface has a slope closer to the short axis at the end of the long axis side as compared with the slope at the end of the opposite side of the electron beam through holes, and the angle of this slope gradually reduces in a direction away from the short axis, and the electron beam through hole array have an inverse slope in an area between a position with a ⅓ distance of the short side distance from the short side of the effective surface and the short side, and thereafter the angle of this inverse slope increases in a direction toward the short side.

Further, according to the present invention, there is provided a color cathode ray tube, comprising: an almost rectangular panel; a phosphor screen formed on an internal surface of an effective portion of the panel; a mask main body, having an almost rectangular shadow mask disposed opposite to the phosphor screen, with a plurality of electron beam through holes being disposed in one line in a short axis direction of the shadow mask on an effective surface of an almost rectangular curved shape opposite to the phosphor screen, and with this electron beam through hole line formed by the plurality of electron beam through holes being laid out by a plurality of number in a long axis direction of the shadow mask; and an almost rectangular mask frame fitted to the periphery of the mask main body, wherein the shadow mask is structured such that, at a position near the short axis, the slope of the electron beam through hole array near the long side of the effective surface has a slope closer to the short axis at the end of the long axis side as compared with the slope at the end of the opposite side of the electron beam through holes, and the angle of this slope gradually reduces in a direction away from the short axis, and the electron beam through hole array have an inverse slope in an area between a position with a ⅓ distance of the short side distance from the short side of the effective surface and the short side, and thereafter the angle of this inverse slope increases in a direction toward the short side.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 9 is a table for showing detailed numerical values of a detailed shape of the effective surface of the shadow mask shown in FIG. 7.

FIG. 12 is a graph for showing a radius of curvature of the electron beam through hole array on the effective surface of the shadow mask shown in FIG. 7.

DETAILED DESCRIPTION OF THE INVENTION

There will be explained a color cathode ray tube relating to one embodiment of the present invention with reference to the drawings.

Figure 7:
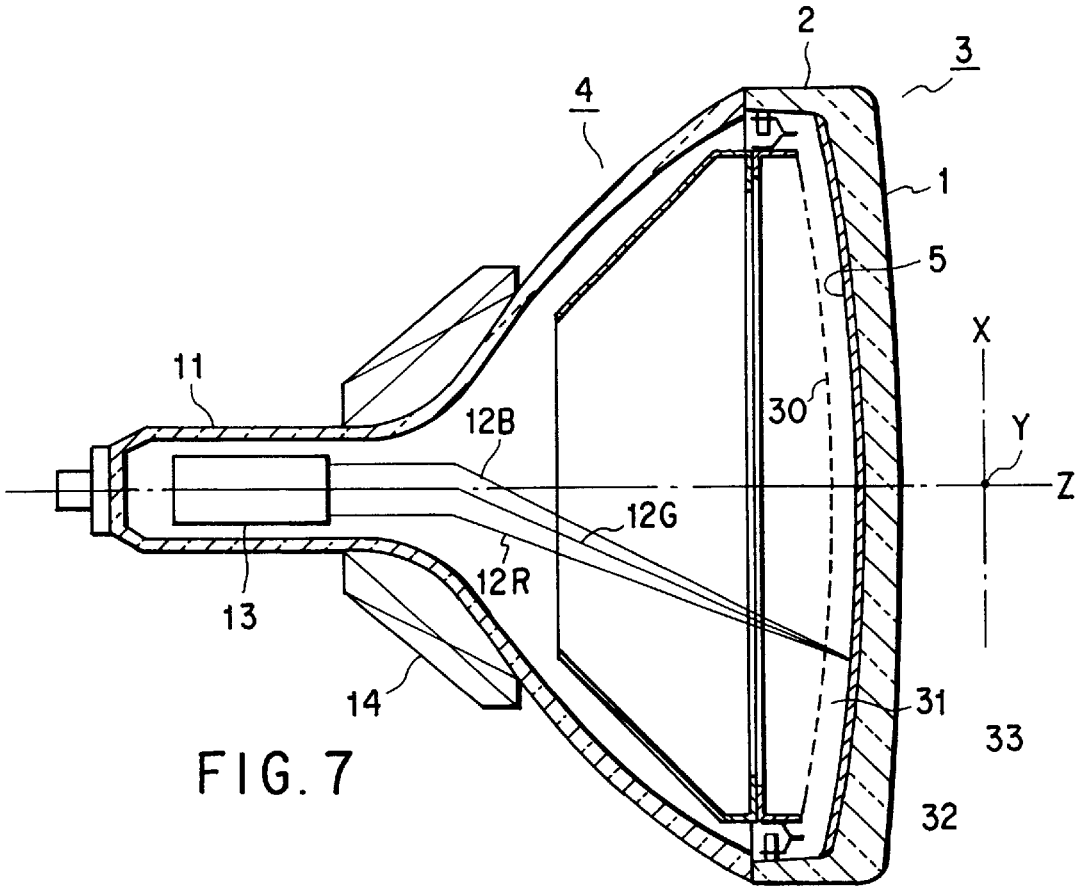
FIG. 7 is a cross-sectional view for schematically showing a structure of a color cathode ray tube relating to one embodiment of the present invention.

FIG. 7 shows a color cathode ray tube according to one embodiment. This color cathode ray tube has an vacuum envelop structured by an almost rectangular panel 3 having a skirt 2 provided at the periphery of an effective portion 1, and a funnel-shaped funnel 4 connected to the skirt 2. On the inner surface of the effective portion 1 of the panel 3, there is provided a phosphor screen 5 structured by a striped black non-light emitting layer extending in the short axis (Y axis) direction, and a striped three-color phosphor layer for light emitting in blue, green and red colors, provided in a slender space in the short axis direction of this black non-light emitting layer. At the inside of the panel 3, there is disposed a shadow mask 33, composed of an almost rectangular mask main body 31 having a large number of electron beam through holes formed on an effective surface 30 opposite to the phosphor screen 5, and an almost rectangular mask frame 32 fitted to the periphery of the mask main body 31. In the mean time, within a neck 11 of the funnel 4, there is disposed an electron gun assembly 13 for emitting three electron beams 12B, 12G and 12R in line in a plane including the long axis. The three electron beams 12B, 12G and 12R emitted from the electron gun assembly 13 are deflected by a magnetic field generated by a deflector 14 mounted on the outside of the funnel 4. These three electron beams 12B, 12G and 12R are then selected by the shadow mask 30 and are directed to the phosphor screen 5. When the phosphor screen 5 is scanned both horizontally and vertically by the three electron beams 12B, 12G and 12R, a color image is displayed on the phosphor screen 5.

Figure 2:
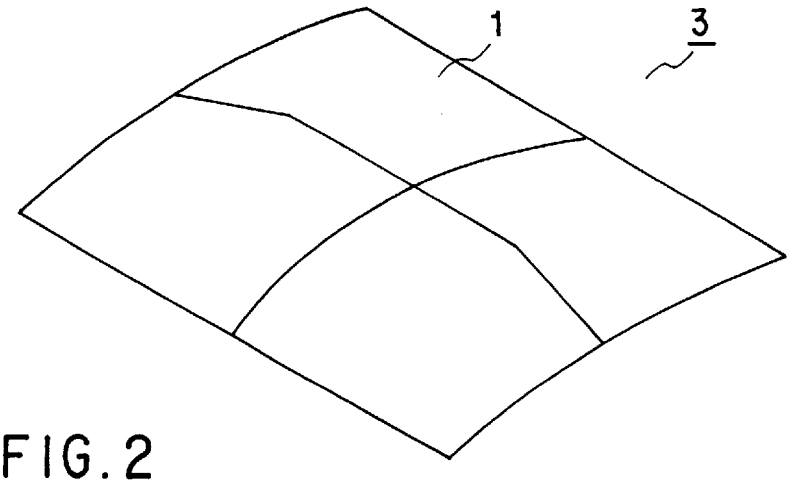
FIG. 2 PRIOR ART
FIG. 2 is a schematic perspective view for explaining a conventional shape of an internal surface of an effective portion of a panel having a flat external shape.
Figure 3A:
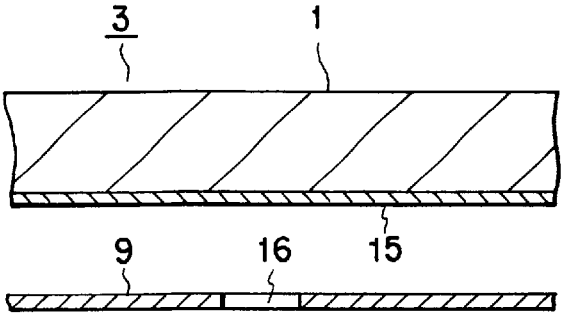
FIGS. 3A to 3G are cross-sectional views for explaining each step of a method of forming a phosphor screen.
Figure 3B:
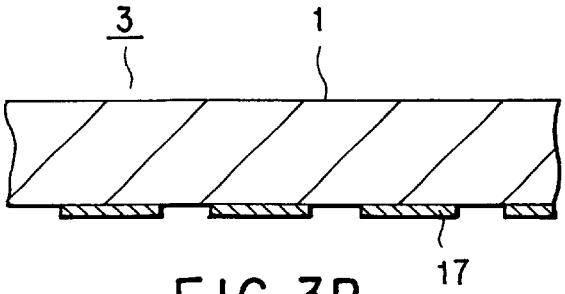
Figure 3C:
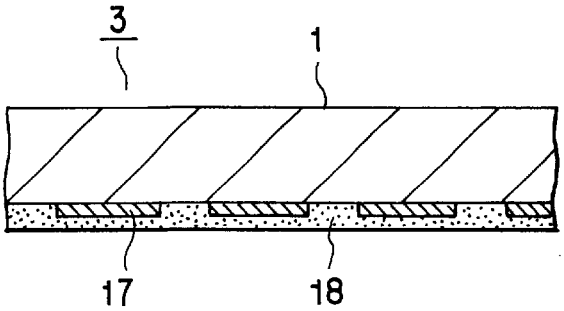
Figure 3D:
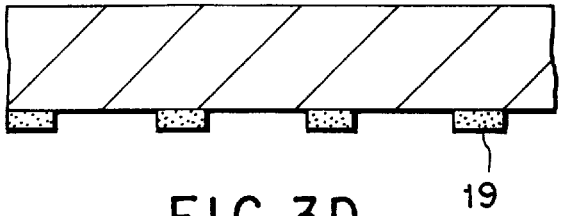
Figure 3E:
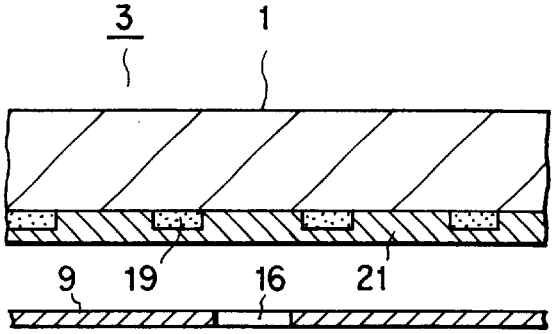
Figure 3F:
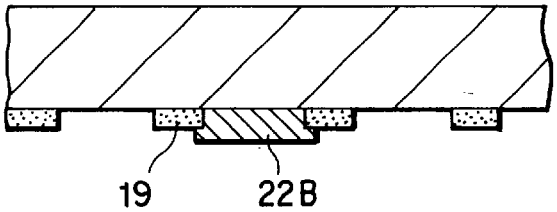
Figure 3G:
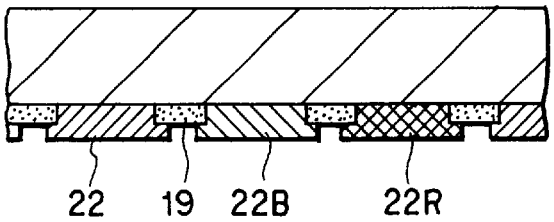
Figure 4A:
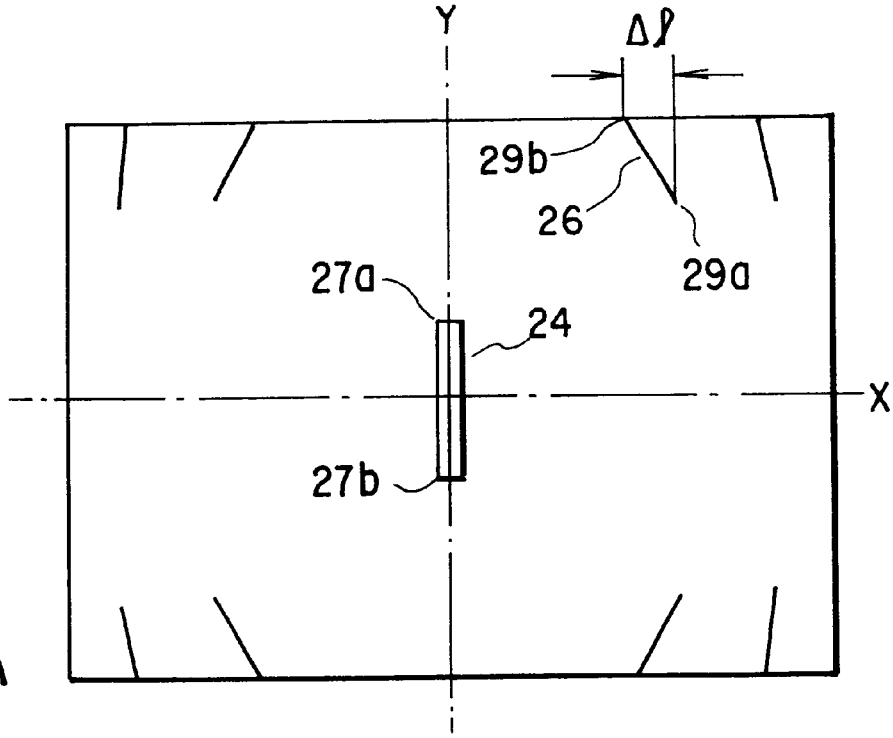
FIG. 4A is a top plan view of a phosphor screen for explaining a relationship of shapes between a long light source, a striped black non-light emitting layer and a three-color phosphor layer to be used for forming a phosphor screen.
Figure 4B:
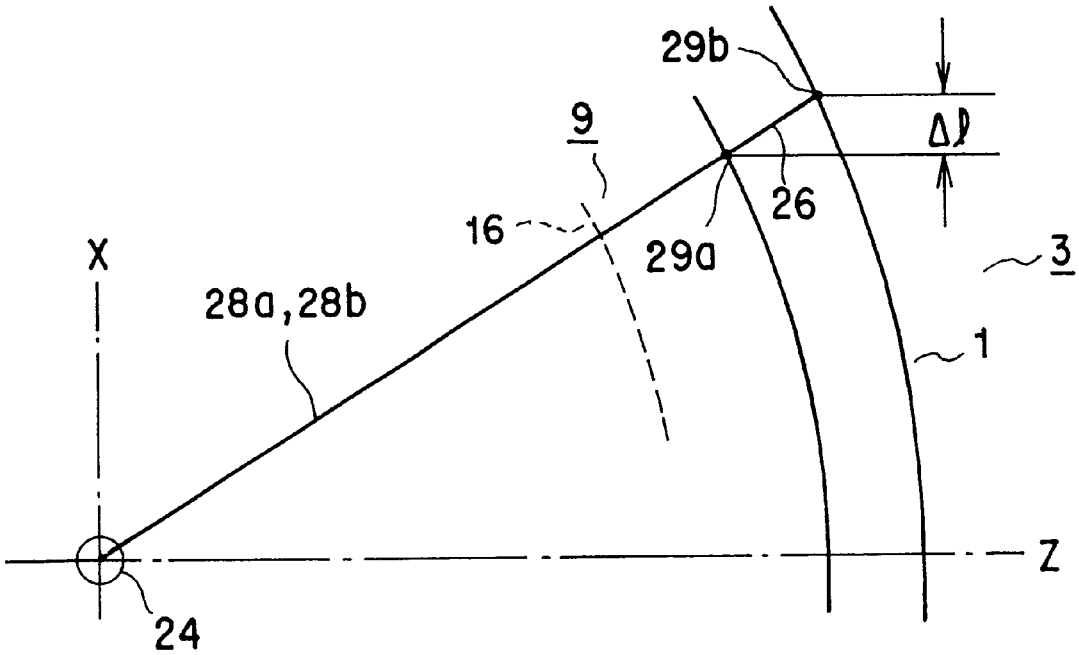
FIG. 4B is an explanatory view for showing a light beam track and an exposure pattern of the long light source at the time of an exposure.
Figure 5A:
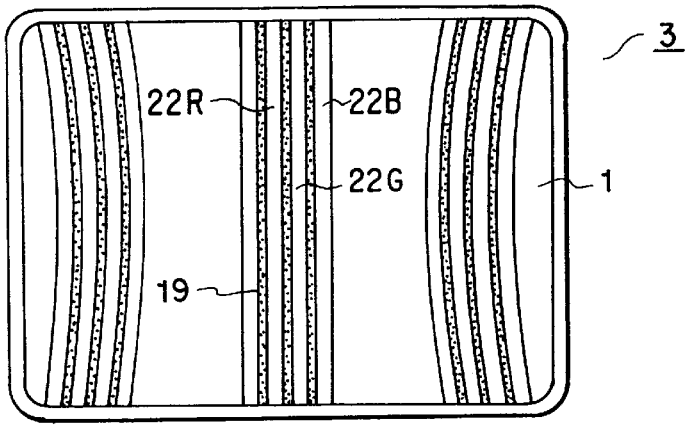
FIG.5A PRIOR ART
FIG. 5A is a top plan view for showing a shape of the striped black non-light emitting layer and the three-color phosphor layer formed on the effective portion of the panel of the conventional color cathode ray tube.
Figure 5B:
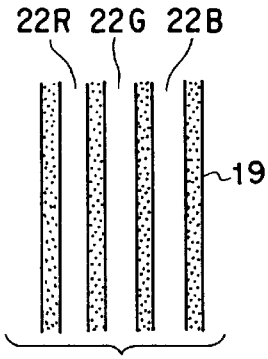
FIG.5B PRIOR ART
FIG. 5B is a top plan view for schematically showing a shape of the black non-light emitting layer and the three-color phosphor layer at a center of the effective portion of the panel shown in FIG. 5A.
Figure 5C:
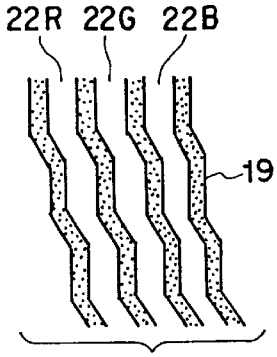
FIG.5C PRIOR ART
FIG. 5C is a top plan view for schematically showing a shape of the black non-light emitting layer and the three-color phosphor layer at an intermediate portion of the effective portion of the panel shown in FIG. 5A.
Figure 6A:
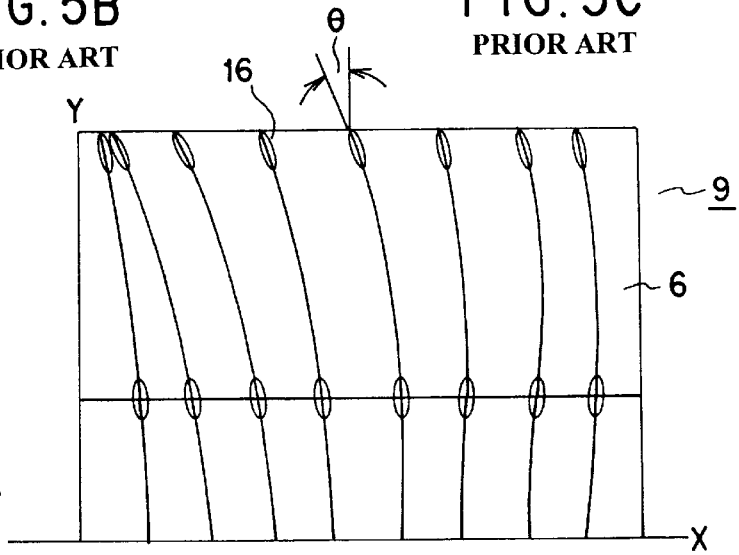
FIG.6A PRIOR ART
FIG. 6A is a top plan view of an effective surface of a shadow mask for explaining a slope of electron beam through hole array of the effective surface of a conventional shadow mask that solves the zigzag of the striped black non-light emitting layer and the three-color phosphor layer.
Figure 6B:
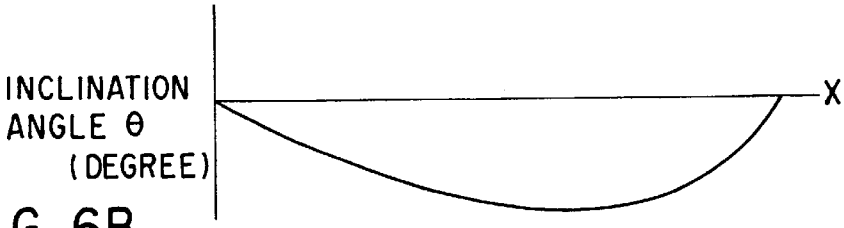
FIG.6B PRIOR ART
FIG. 6B is a graph for showing a change of the slope of the electron beam through hole array on the effective surface of the shadow mask shown in FIG. 6A.

The panel 3 is formed to have a flat surface for the effective portion 1, and the external surface of the effective portion 1 is formed in a flat surface or a shape near a flat surface having a slight curvature of about 50,000 R. The internal surface of the effective portion 1 has a curvature in its short axis (Y axis) direction in a manner similar to that of the conventional panel shown in FIG. 2. In the long axis (X axis) direction of the internal surface of the effective portion 1, the radius of curvature in the long axis direction is set almost infinite from the center toward the intermediate portion. The radius of curvature in the long axis direction near the periphery of the short side is formed smaller than the radius of curvature in the long axis direction from the center toward the intermediate portion.

Figure 8A:
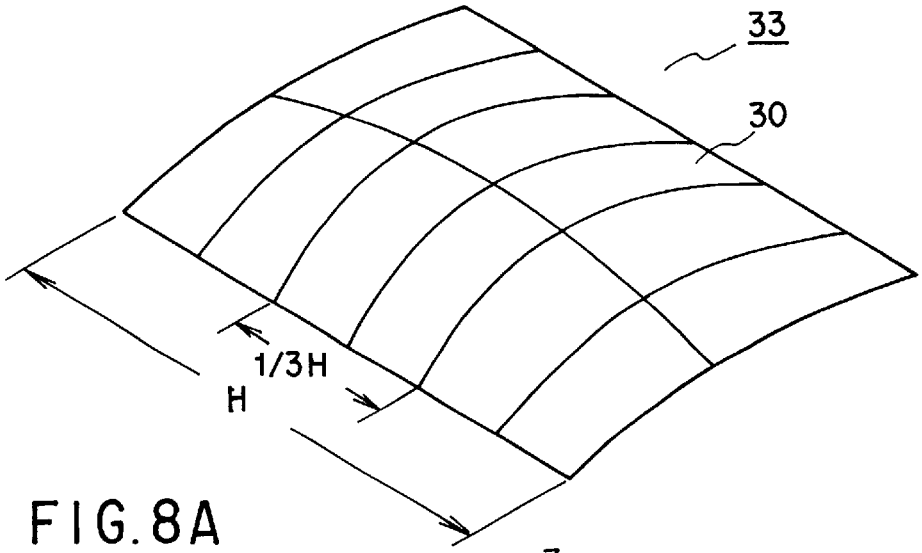
FIG. 8A is a perspective view for schematically showing a shape of the effective surface of the shadow mask shown in FIG. 7.
Figure 8B:
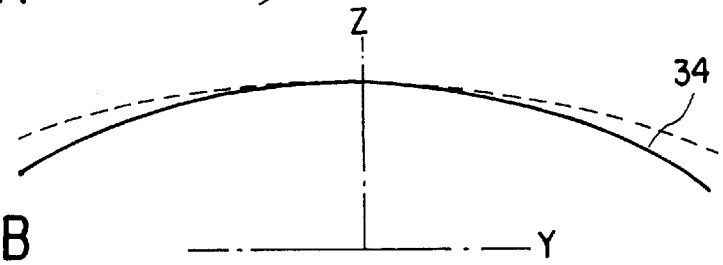
FIG. 8B is a cross-sectional view for showing a curvature of the effective surface of the shadow mask shown in FIG. 8A in the short axis direction near the short axis.

On the other hand, as shown in FIG. 8A, the effective surface 30 of the shadow mask 33 is formed such that, in the long axis direction, the radius curvature in the long axis direction is set almost infinite from the center toward the intermediate portion, and the radius of curvature in the long axis direction near the short side is formed smaller than the radius of curvature in the long axis direction from the center toward the intermediate portion. The effective surface 30 of the shadow mask 33 is also structured such that, in the short axis direction, in a region between a position with a ⅓ distance of a short side distance H from the short axis and the short axis, the curvature near the short axis is set maximum, and the curvature becomes gradually smaller in a direction away from the short axis, as shown in FIG. 8B. FIG. 12 shows shapes of the effective surface of the shadow mask 33 in radius of curvature, for a case of a color cathode ray tube having a diagonal effective length of 76 cm and an aspect ratio of 16:9, as one example.

On the effective surface 30 of the shadow mask 33, there are arranged a plurality of electron beam through holes or apertures in a line or array along a short axis direction, the through holes being separated by bridges. This electron beam through hole arrays or lines each consisting of the plurality of electron beam through holes in the short axis direction are arranged along the long axis direction of the effective surface 30 of the shadow mask 33. In particular, in the present embodiment, on the long axis, the distance between the electron beam through hole arrays increases monotonously in a direction away from the short axis (the center of the effective surface), as shown by a curve 35 in FIG. 10.

Figure 10:
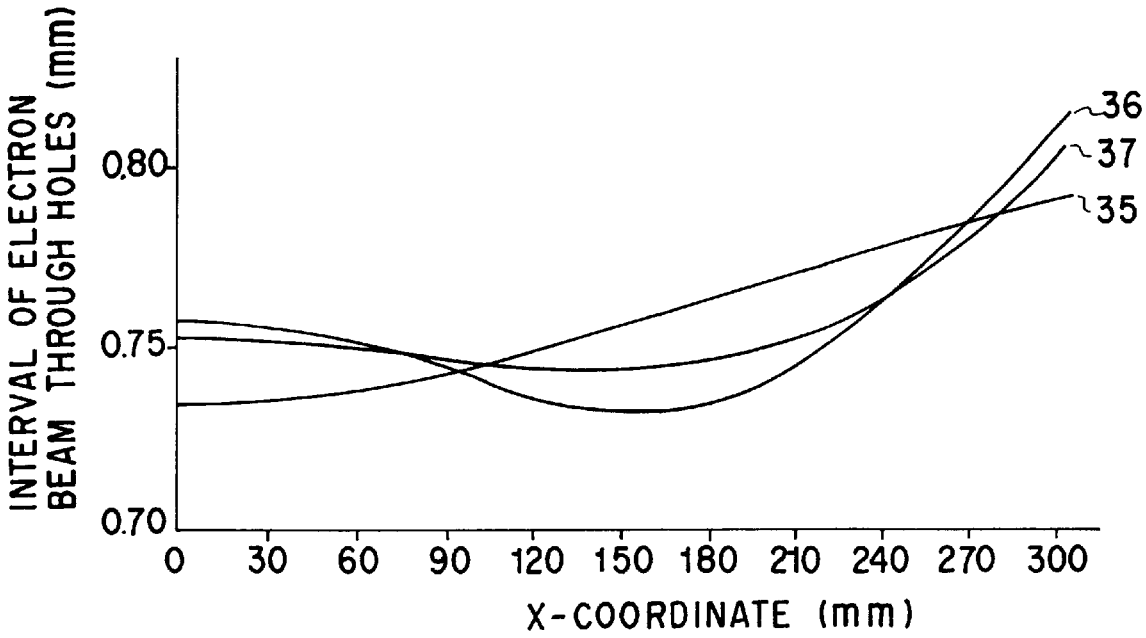
FIG. 10 is a graph for showing a change in the distance between the electron beam through hole array on the effective surface of the shadow mask shown in FIG. 7.

On the other hand, at a position near the long side, the distance is larger near the short axis than the distance at the center of the effective surface, then, at the intermediate portion in the long axis direction, the distance becomes smaller and gradually increases thereafter, and at a position near the short side, the distance becomes equal to or larger than the distance near the short axis, as shown by a curve 36 in FIG. 10. On the other hand, at the intermediate portion in the short axis direction, the distance near the short axis is smaller than the distance near the long side, then, at the intermediate portion in the long axis direction, this distance is smaller than the distance near the short axis and is also larger than the distance near the long side, and thereafter the distance increases and, at a position near the short side, the distance becomes equal to or larger than the distance near the short axis, as shown by a curve 37 in FIG. 10.

Figure 11:
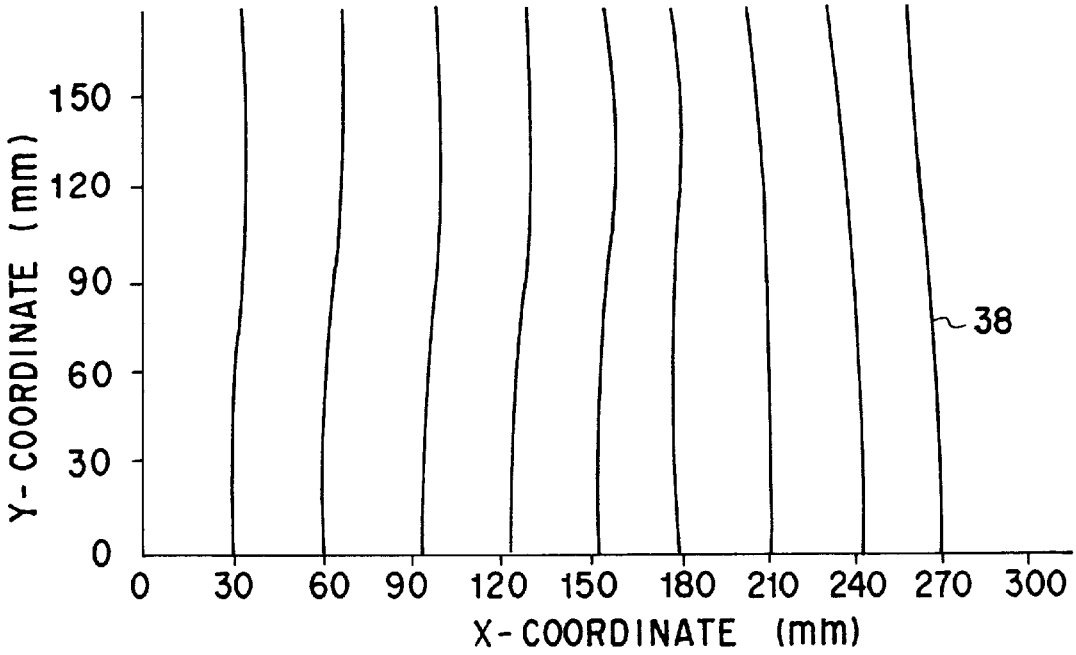
FIG. 11 is a graph for showing a slope of the electron beam through hole array on the effective surface of the shadow mask shown in FIG. 7.

Corresponding to these distances between the electron beam through hole arrays, the slope of each electron beam through hole line changes as shown by a curve 38 in FIG. 11. Each electron beam through hole constituting the electron beam through hole array has two ends, i.e., one end on the side of the long axis and the other end on the side of the long side, and is sloped at a slope angle which is determined in accordance with the position of each electron beam through hole. The slope angle of each electron beam through hole is positive if the one end thereof is closer to the short axis than the other end, and the slop angle of each electron beam through hole is negative if the other end thereof is closer to the short axis than the one end. If the electron beam through hole is located near the long side and the short axis, it is sloped at a positive angle. The slope angle gradually decreases in a direction away from the short axis, and the slope changes to a negative direction in an area between a position with a ⅓ distance of the short side distance H from the short side and the short side, and the slope angle of this negative direction increases toward the short side. FIG. 9 shows an example of slopes (slope angles) of the electron beam through holes for structuring the electron beam through hole array, for a color cathode ray tube having a diagonal effective length of 76 cm and an aspect ratio of 16:9, as one example.

If the shadow mask 33 is structured as described above, it becomes possible to improve the strength of the curved surface of the effective surface 30 of the shadow mask 33 flattened along with the flattening of the effective portion 1 of the panel 3. It also becomes possible to prevent a local deformation in the process of manufacturing the shadow mask and the color cathode ray tube. Further, it is possible to reduce oscillation generated by a sound from the speaker at the time when the color cathode ray tube is built into the image receiver. It is also possible to reduce howling of color purity due to a miss-landing of beam landing attributable to these problems. At the same time, it is possible to avoid the zigzag of the striped black non-light emitting layer 3 or the three-color phosphor layer, so that the phosphor screen can be maintained in good condition.

Figure 1:
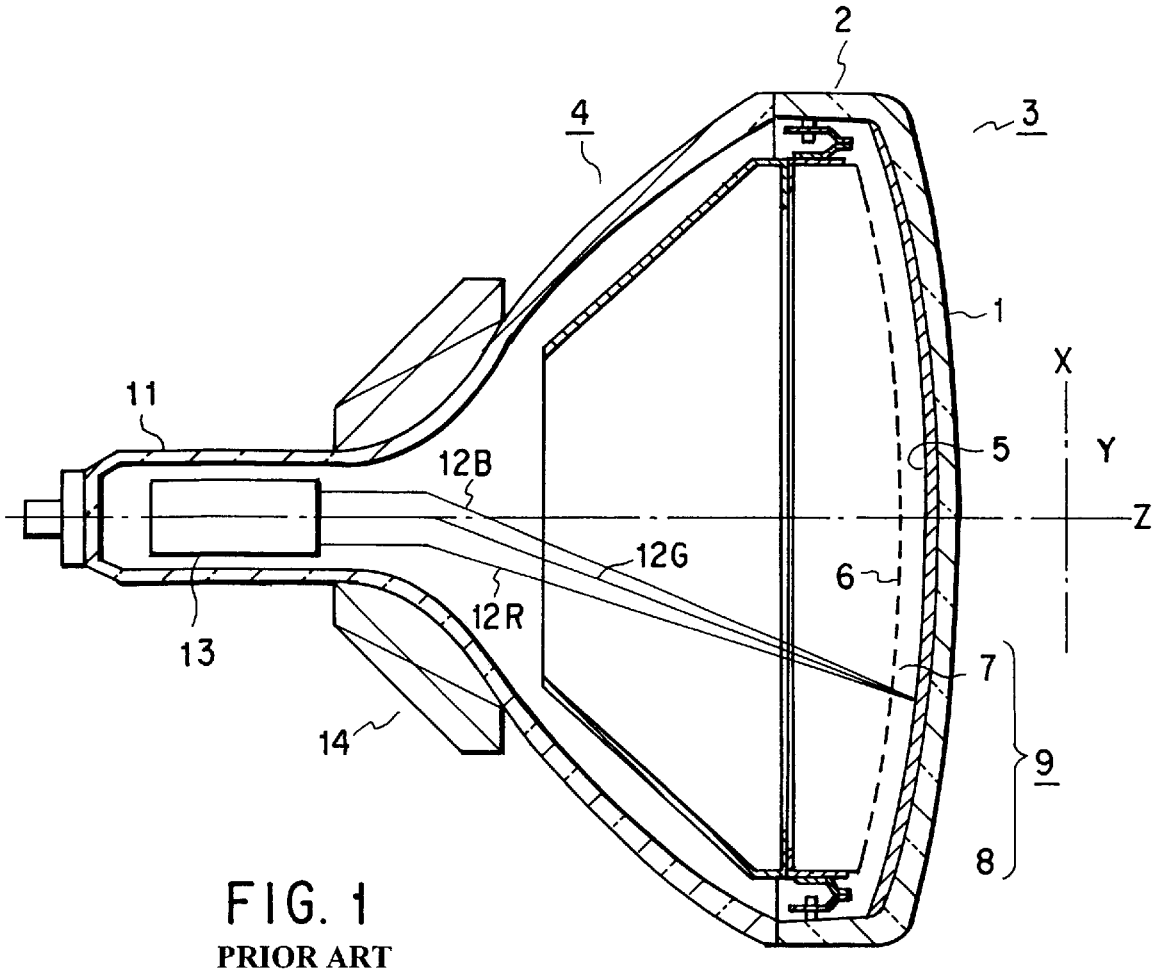
FIG. 1 PRIOR ART
FIG. 1 is a cross-sectional view for schematically showing a structure of a conventional color cathode ray tube.

In other words, according to the conventional shadow mask for the color cathode ray tube of which effective portion has been flattened following the flattening of the panel for improving the visibility as shown in FIG. 1, sufficient strength of the curved surface of the effective portion cannot be obtained. Particularly, there is insufficient strength in the curved surface near the center. On the other hand, according to the present embodiment, the effective surface of the color cathode ray tube is structured such that, in the long axis direction, the radius of curvature in the long axis direction is set almost infinite from the center toward the intermediate portion, and the radius of curvature in the long axis direction near the short side is formed smaller than the radius of curvature in the long axis direction from the center toward the intermediate portion, and that in an area between a position with a ⅓ distance of the short side distance H and the short axis, the curvature is set as maximum near the short axis and the curvature becomes gradually smaller in a direction away from the short axis. Based on this structure, as the curvature near the center in the short axis direction has been increased, the strength of the curved surface of the shadow mask can be increased effectively.

Generally, since the long side distance of the shadow mask is smaller than the short side distance thereof, it is easier to have a larger curvature in the short axis direction if a drop distance between the center of the effective surface and the long side along the tube axis (Z axis) is substantially same as a drop distance between the center of the effective surface and the short side along the tube axis (Z axis). On the other hand, in the case of the shadow mask having a plurality of electron beam through holes arranged in one line or array in the short axis direction, and having a plurality of these electron beam through hole array of the short axis direction arranged along the long axis direction, the formations of the through holes along the short axis direction and the long axis direction are different and there is no continuous part but intermittent in the long axis direction although there are continuous linear parts in the short axis direction. Accordingly, even if the curvatures are similar, the strength of the curved surface can be increased more by increasing the curvature of in the short axis direction.

Figure 14A:
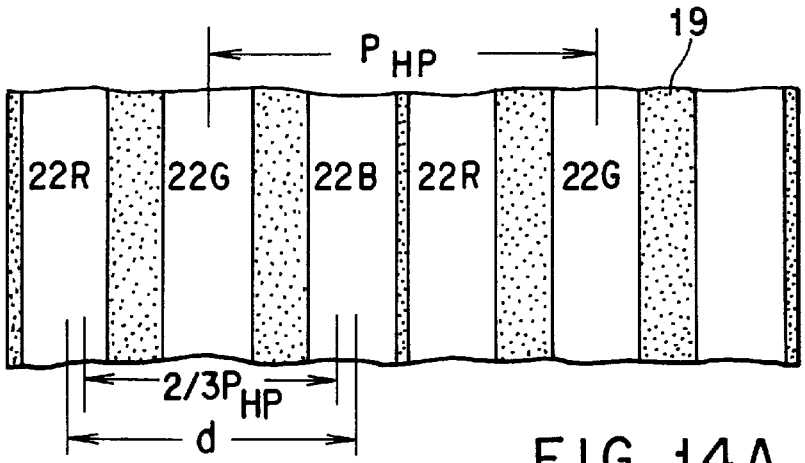
FIG. 14A is a top plan view for explaining a layout of the striped black non-light emitting layer and the three-color phosphor layer in the case where the layout of the electron beam through hole array on the effective surface of the shadow mask is not suitable.
Figure 14B:
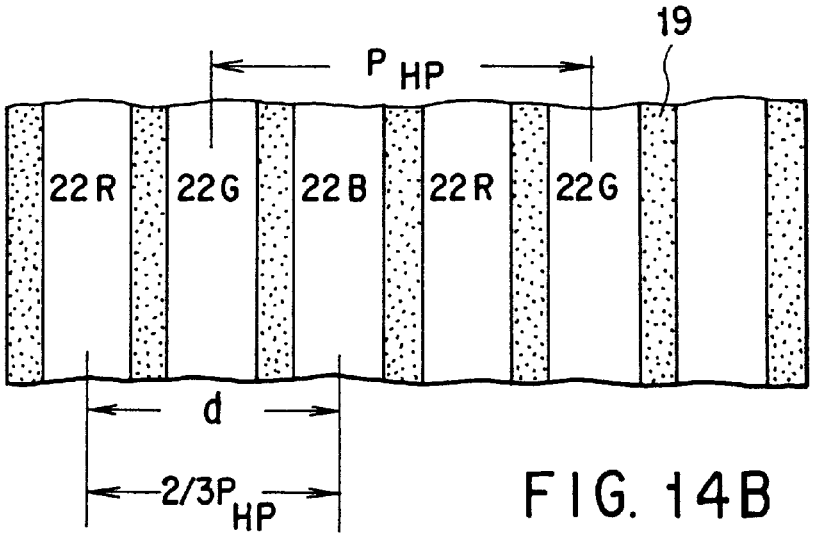
FIG. 14B is a top plan view for explaining a layout of the striped black non-light emitting layer and the three-color phosphor layer in the case where the layout of the electron beam through hole array on the effective surface of the shadow mask is suitable.

However, in this case, if the electron beam through hole array in the short axis direction are arranged in an equal distance in the long axis direction, the electron beam through holes that are originally located at a suitable position move from a point 40 to a point 41, and the distance (q value) between the internal surface of the effective portion 1 of the panel 3 and the effective surface 30 of the shadow mask 33 becomes larger. Accordingly, the width and the distance of the striped black non-light emitting layer 19 near the long side of the phosphor screen does not become uniform, as shown in FIG. 14A. As a result, ⅔ of a distance PHP of the same phosphor layer (as shown for the phosphor layer 22G in the drawing) in comparison with a distance d of the three-color phosphor layers 22B, 22G and 22R, becomes as follows.

$$d>(2/3)\cdot PHP$$

Figure 13:
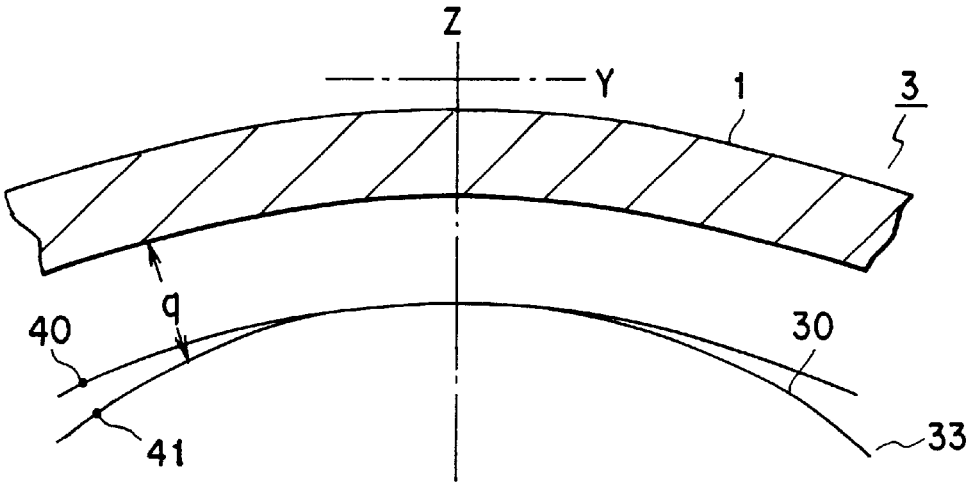
FIG. 13 is a schematic cross-sectional view for explaining a relationship of distance between the internal surface of the effective portion of the panel and the effective surface of the shadow mask of the color cathode ray tube shown in FIG. 7.

However, if, the curvature in the short axis direction is increased like the present embodiment, and if, as shown in FIG. 10, the distance of the electron beam through hole array is set such that, at a position near the long side, the layout distance near the short axis is larger than the layout distance at the center of the effective surface, that the layout distance in the intermediate portion in the long axis direction is smaller than the layout distance near the short axis, and that, at a position near the short side, the layout distance is equal to or larger than the layout distance near the short axis, then it becomes possible to set uniform the width and the distance of the striped black non-light emitting layer 18 near the long side of the phosphor screen as follows, even if the electron beam through holes move from the point 40 to the point 41, as shown in FIG. 13.

$$d=(2/3)\cdot PHP$$

Figure 15:
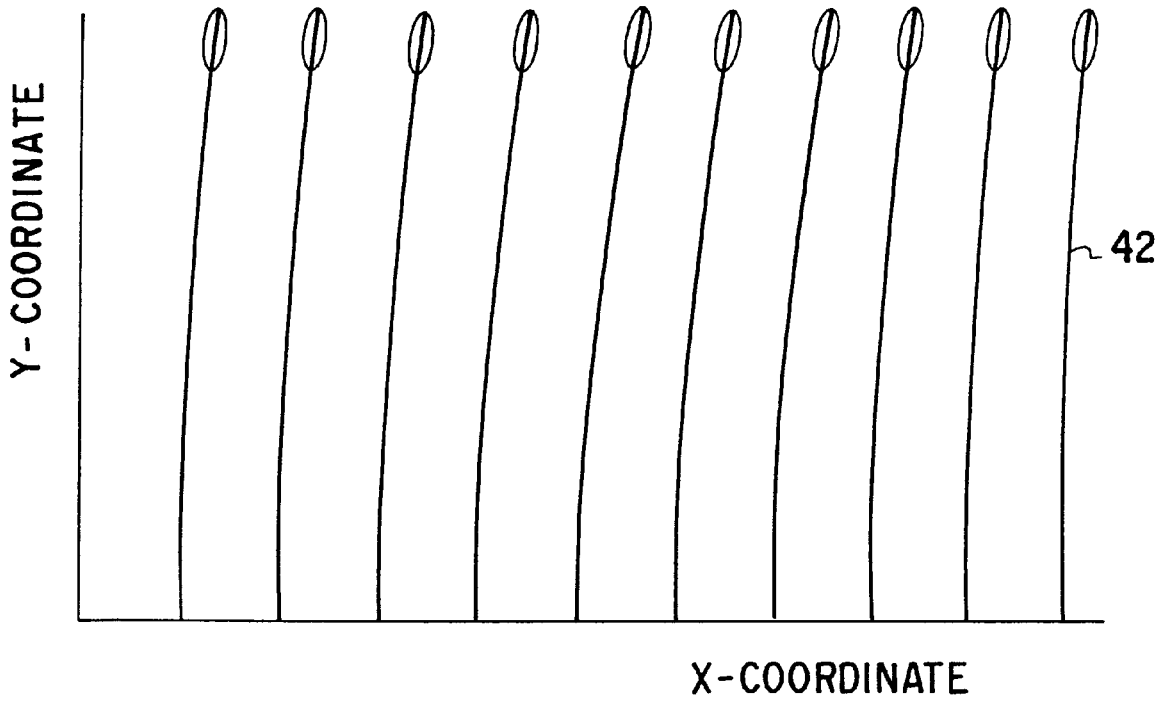
FIG. 15 is a schematic cross-sectional view for showing a detailed example of a slope of the electron beam through hole array on the effective surface of the shadow mask necessary for providing a suitable layout of the striped black non-light emitting layer and the three-color phosphor layer.

However, if the layout distance of 22B, 22G and 22R of the three-color phosphor layers near the long side of the phosphor screen is set as explained above, the slope of the electron beam through hole array near the long side of the shadow mask becomes such that, at a position near the short axis, the end of the long axis of the electron beam through holes is inclined to the direction near the short axis as against the end of the opposite side, and this slope angle increases, and the black non-light emitting layer and the phosphor layer make a zigzag move, as shown by curves 42 in FIG. 15. However, in this case, as shown in FIG. 11, the slope of the electron beam through hole array near the long side is set such that, at a position near the short axis, the electron beam through holes is sloped in a positive direction closer to the short axis than at the end at the opposite side, and this slope angle is gradually decreased in a direction away from the short axis, and that, in the area between a position with a ⅓ distance of the short side distance H from the short side and the short side, the electron beam through holes are sloped in a negative direction, and this slope angle in the negative direction gradually increases toward the short side. Further, the layout distance of the electron beam through hole array in the intermediate portion on the long axis and in the short axis direction is set as shown in FIG. 10, and the layout distance of the electron beam through hole array near the corner is adjusted so that the effective diameter of the phosphor screen becomes suitable. Accordingly, there does not exist a zigzag of the black non-light emitting layer and the phosphor layer, and the effective diameter of the phosphor screen is set suitable.

In other words, even if the effective surface 30 of the shadow mask 33 has been flattened along with the flattening of the effective portion 1 of the panel 3 for improving the visibility, the following various advantages can be obtained by providing a curvature on the effective surface 30 as shown in FIG. 8A and by setting the layout distance and the slope of the electron beam through hole array to be formed on this effective surface 30 as shown in FIG. 10 and FIG. 11. Namely, it becomes possible to improve the strength of the curved surface of the shadow mask 33, to be able to prevent a local deformation of the shadow mask and the color cathode ray tube in the manufacturing process. It is also becomes possible to reduce oscillation due to a sound from the speaker when the color cathode ray tube has been built into the image receiver. Moreover, it becomes possible to reduce howling of the color purity due to a mislanding of the beam landing attributable to this oscillation. At the same time, it becomes possible to avoid zigzag of the striped black non-light emitting layer 19 and 22B, 22G and 22R of the three-color phosphor layer. This results in a satisfactory picture quality on the phosphor screen 5.

In the above embodiment, description has been made of the color cathode ray tube having the phosphor screen structured by the striped black non-light emitting layer and the three-color phosphor layer. However, it is also possible to obtain a similar effect if the present invention is applied to a color cathode ray tube having a phosphor screen structured by only a striped three-color phosphor layer.

Further, in the above embodiment, description has been made of the color cathode ray tube in which the external surface of the effective portion of the panel has a flat surface or a slight curvature. However, it is also possible to apply the present invention to a color cathode ray tube in which the external surface of the effective portion has a conventional curvature. In this case, it is also possible to avoid zigzag of the striped black non-light emitting layer and the three-color phosphor layer, and to obtain satisfactory picture quality on the phosphor screen.

As described above, according to the present invention, by setting the curved surface for the effective surface of the shadow mask, and by setting the layout distance and the slope for the electron beam through hole array to be provided on this effective surface, it is possible to obtain the following advantages. Namely, it becomes possible to improve the strength of the curved surface of the shadow mask, to be able to prevent a local deformation of the shadow mask and the color cathode ray tube in the manufacturing process. It is also becomes possible to reduce oscillation due to a sound from the speaker when the color cathode ray tube has been built into the image receiver. Further, it becomes possible to reduce howling of the color purity due to a mislanding of the beam landing attributable to this oscillation. At the same time, it becomes possible to avoid zigzag of the striped black non-light emitting layer and the three-color phosphor layer. This results in a satisfactory picture quality on the phosphor screen.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube, comprising:

a substantially rectangular panel having a flat surface or having a slight curvature on its external surface, a phosphor screen formed on an intemal surface of an effective portion of the panel;

a shadow mask having a substantially rectangular main body having a pair of short sides and a pair of long sides and disposed faced to the phosphor screen, with a plurality of electron beam through holes being arranged in an array in a direction of a short axis of the shadow mask on an effective surface of a substantially rectangular curved shape opposite to the phosphor screen, and with a plurality of the electron beam through hole arrays of the plurality of electron beam through holes being arranged in a direction of a long axis of the shadow mask, the short axis and long axis passing through a center of the effective surface and being parallel with the short side and the long side of the effective surface, respectively; and an almost rectangular mask frame fitted to the periphery of the mask main body, wherein the through holes are so arranged such that the distance between the adjacent electron beam through hole arrays near a long side of the effective surface is larger than the distance between the adjacent electron beam through hole arrays at the center of the effective surface near the short axis of the shadow mask, at the position near a long side, the distance between the adjacent electron beam through hole arrays becomes gradually smaller in a direction away from the short axis to a predetermined point, and increases thereafter such that at a position near the short side of the effective surface, the distance becomes equal to or larger than the distance near the short axis, and along the long axis, the distance between the adjacent electron beam through hole arrays increases monotonically in a direction away from the short axis to a short side.

2. A color cathode ray tube according to claim 1, wherein the effective surface of the shadow mask is structured such that the effective surface has a curvature in the short axis direction, have a long side distance between the short sides and in an area between positions with a ⅓ distance of the long side distance along the long axis direction from the short axis, the curvature in the short axis direction is a maximum near the short axis and the curvature becomes gradually smaller in a direction away from the short axis.

3. A color cathode ray tube, comprising:

a substantially rectangular panel having an internal surface;

a phosphor screen formed on the internal surface of an effective portion of the panel;

a shadow mask, having a substantially rectangular main body having a pair of short sides and a pair of long sides and disposed opposite to the phosphor screen, with a plurality of electron beam through holes being arranged in an array in a short axis direction of the shadow mask on an effective surface of a substantially rectangular curved shape opposite to the phosphor screen, and with a plurality of the electron beam through hole arrays of the plurality of electron beam through holes being arranged in a direction of a long axis of the shadow mask, the short axis and long axis passing through a center of the effective surface and being parallel with the short side and the long side of the effective surface, respectively; and a substantially rectangular mask frame fitted to the periphery of the mask main body, wherein the through holes are so arranged that the distance between the electron beam through hole arrays on the long axis increases gradually in a direction away from the short axis, and at a position near the long side of the effective surface, the distance becomes smaller at an intermediate portion between the areas near the short side and the short axis in the long axis direction than the distance near the short axis.

4. A color cathode ray tube, comprising:

a substantially rectangular panel having internal and external surfaces, the external surface being substantially flat or having a slight curvature;

a phosphor screen formed on an internal surface of an effective portion of the panel;

a shadow mask, having a substantially rectangular main body having a pair of short sides and a pair of long sides and arranged opposite to the phosphor screen, with a plurality of electron beam through holes being arranged in an array in a short axis direction of the shadow mask on an effective surface of a substantially rectangular curved shape opposite to the phosphor screen, and with a plurality of the electron beam through hole arrays of the plurality of electron beam through holes being arranged in a direction of a long axis of the shadow mask, the short axis and long axis passing through a center of the effective surface and being parallel with the short side and the long side of the effective surface, respectively; and a substantially rectangular mask frame fitted to the periphery of the mask main body, wherein the through holes are so arranged that the distance between the electron beam through hole arrays on the long axis increases gradually in a direction away from the short axis, and at a position near the long side of the effective surface, the distance becomes smaller at an intermediate portion between the areas near the short side and the short axis in the long axis direction than the distance near the short axis.

5. A color cathode ray tube comprising:

a substantially rectangular panel having an internal surface;

a phosphor screen formed on the internal surface of an elective portion of the panel;

a shadow mask, having a substantially rectangular main body having a pair of short sides and a pair of long sides and a width defined between the short sides, and disposed opposite to the phosphor screen, with a plurality of through holes being disposed in one line in a short axis direction of the shadow mask on an effective surface of a substantially rectangular curved shape opposite to the phosphor screens and with a plurality of electron beam through hole lines formed by the plurality of through holes being laid out by a plurality of number in a direction of a long axis of the shadow mask, the short axis and long axis passing through a center of the effective surface and being parallel with the short side and the long side of the effective surface, respectively; and a substantially rectangular mask frame fitted to the periphery of the mask main body, wherein each of the through holes has an elongated shape, one and opposite ends and a longitudinal axis passing through the one and opposite ends, the one end being positioned at the side of the long axis and the opposite end being positioned at the side of the long side, the longitudinal axes of the through holes located near the long side are arranged to have first inclinations in an area near the short axis, each of the first inclinations defining a first distance between the one end and the short axis being smaller than a second distance between the opposite end and the short axis, the first inclination being changed depending on the distance from the short axis to a predetermined position to decrease the difference between the first and second distance, the predetermined position being at ⅓ the width from the short axis to the short side, to have a second inclination substantially parallel to the short axis in an area near the predetermined position and to have a third inclination in an area between the predetermined position and the short side, each of the third inclinations defining the first distance between the one end and the short axis being larger than the second distance between the opposite end and the short axis, the third inclination being changed depending on the distance from the predetermined position to the short side to increase the difference between the first and second distance.

6. A color cathode ray tube, comprising:

an almost rectangular panel having internal and external surfaces, the external surface being substantially flat or having a slight curvature;

a phosphor screen formed on the internal surface of an effective portion of the panel;

a shadow mask, having a substantially rectangular main body having a pair of short sides and a pair of long sides and disposed opposite to the phosphor screen, with a plurality of through holes being disposed in an array in a short axis direction of the shadow mask on an effective surface of a substantially rectangular curved shape opposite to the phosphor screen, and with the through hole arrays of the plurality of through holes being arranged in a direction of a long axis of the shadow mask, the short axis and long axis passing through a center of the effective surface and being parallel with the short side and the long side of the effective surface, respectively; and a substantially rectangular mask frame fitted to the periphery of the mask main body, wherein each of the through holes has an elongated shape, one and opposite ends and a longitudinal axis passing through the one and opposite ends, the one end being positioned at the side of the long axis and the opposite end being positioned at the side of the long side, the longitudinal axes of the through holes located rear the long side are arranged to have first inclinations in an area near the short axis, each of the first inclinations defining a first distance between the one end and the short axis being smaller than a second distance between the opposite end and the short axis, the first inclination being changed depending on the distance from the short axis to a predetermined position to decrease the difference between the first and second distance, the predetermined position being at ⅓ the width from the short axis to the short side, to have a second inclination substantially parallel to the short axis in an area near the predetermined position and to have a third inclination in an area between the predetermined position and the short side, each of the third inclinations defining the first distance between the one end and the short axis being larger than the second distance between the opposite end and the short axis, the third inclination being changed depending on the distance from the predetermined position to the short side to increase the difference between the first and second distance.

* * * * *